US007663573B2

(12) United States Patent
Kim et al.

(10) Patent No.: US 7,663,573 B2
(45) Date of Patent: Feb. 16, 2010

(54) PLASMA DISPLAY PANEL AND DRIVING METHOD THEREOF

(75) Inventors: Jin Young Kim, Daegu (KR); Hee Chan Yang, Busan (KR)

(73) Assignee: LG Electronics Inc., Seoul (KR)

( * ) Notice: Subject to any disclaimer, the term of this patent is extended or adjusted under 35 U.S.C. 154(b) by 1051 days.

(21) Appl. No.: 11/155,689

(22) Filed: Jun. 20, 2005

(65) Prior Publication Data

US 2006/0044221 A1 Mar. 2, 2006

(30) Foreign Application Priority Data

Aug. 27, 2004 (KR) ..... 10-2004-0067924

(51) Int. Cl.
*G09G 3/28* (2006.01)

(52) U.S. Cl. ..... 345/60; 345/67; 315/169.1

(58) Field of Classification Search ..... 345/60–68; 315/169.1–169.4
See application file for complete search history.

(56) References Cited

U.S. PATENT DOCUMENTS

| | | | | |
|---|---|---|---|---|
| 5,990,630 | A * | 11/1999 | Nakamura | 315/169.4 |
| 6,219,013 | B1 * | 4/2001 | Amano | 345/60 |
| 6,340,960 | B1 * | 1/2002 | Song et al. | 345/60 |
| 6,529,177 | B2 * | 3/2003 | Nakamura | 345/60 |
| 6,577,071 | B2 | 6/2003 | Matsumoto | |
| 2001/0024179 | A1 | 9/2001 | Nakamura | |
| 2003/0011539 | A1 * | 1/2003 | Kubota et al. | 345/60 |
| 2005/0052354 | A1 * | 3/2005 | Chae et al. | 345/60 |
| 2007/0171149 | A1 * | 7/2007 | Hashimoto et al. | 345/60 |

FOREIGN PATENT DOCUMENTS

| | | | |
|---|---|---|---|
| EP | 0853306 | A1 | 7/1998 |
| JP | 08-305319 | | 11/1996 |
| JP | 10-091117 | | 4/1998 |
| JP | 10-123998 | | 5/1998 |
| JP | 10-198304 | | 7/1998 |
| JP | 2000-276107 | | 10/2000 |
| JP | 2001-272948 | | 10/2001 |
| KR | 10-2003-0035666 | | 5/2003 |
| KR | 1020030046023 | A | 6/2003 |
| KR | 10-2003-0067931 | A | 8/2003 |
| KR | 10-2003-0069024 | A | 8/2003 |
| KR | 10-20030067931 | A | 8/2003 |
| TW | 397963 | | 7/2000 |
| TW | 530283 | | 5/2003 |

* cited by examiner

*Primary Examiner*—Richard Hjerpe
*Assistant Examiner*—Kimnhung Nguyen
(74) *Attorney, Agent, or Firm*—McKenna Long & Aldridge LLP

(57) ABSTRACT

The present invention relates to a plasma display panel and driving method thereof, which involves controlling the time points when data signals are applied to the data electrodes during an address period, thereby reducing the noise that otherwise affects the waveforms applied to the Y electrodes and the Z electrodes. This, in turn, stabilizes the address discharge and prevents damage to the scan board and/or the sustain board. According to one embodiment of the present invention, the data electrodes are divided into a plurality of electrode groups, where each of the electrode groups receives the data signal at an application time point that is different from the remaining electrode groups.

30 Claims, 13 Drawing Sheets

PLASMA DISPLAY PANEL AND DRIVING METHOD THEREOF

This Nonprovisional application claims priority under 35 U.S.C. §119(a) to Patent Application No. 10-2004-0067924 filed in Korea on Aug. 27, 2004, the entire contents of which are hereby incorporated by reference.

BACKGROUND OF THE INVENTION

1. Field of the Invention

The present invention relates to a plasma display panel, and more particularly, to a plasma display panel and driving method thereof, which controls the time data signals are applied to X electrodes during an address period, thereby reducing noise affecting waveforms that are applied to the Y electrodes and/or Z electrodes, stabilizing an address discharge, and preventing damage to the scan board and/or a sustain board.

2. Background of the Related Art

A plasma display panel includes barrier ribs formed between a front substrate and a rear substrate. Together, the barrier ribs and the front and rear substrates from cells. Each of the cells is filled with a primary discharge gas such as neon (Ne), helium (He) or a mixed gas comprising Ne and He. In addition, each cell contains an inert gas comprising a small amount of xenon.

If the inert gas is discharged using a high frequency voltage, ultraviolet rays are generated. The ultra-violet rays, which are invisible to the human eye, excite light-emitting phosphors in each cell, thus creating a visible image. Plasma display panels can be made thin and slim, and have thus been in the spotlight as the next-generation of display devices.

FIG. 1 is a perspective view illustrating the configuration of a conventional plasma display panel. As shown in FIG. 1, the plasma display panel includes a front substrate 100 that serves as the display surface on which the images are displayed, and a rear substrate 110 forming a rear surface. The front substrate 100 and the rear substrate 110 are parallel to each other, with a predetermined distance therebetween.

The front substrate 100 includes a scan electrode 101 (Y electrode) and a sustain electrode 102 (Z electrode), both of which are employed in controlling the discharge and light emission of the discharge cell shown in FIG. 1. The Y electrode 101 and the Z electrode 102 each have a transparent electrode "a" made of a transparent ITO material, and a bus electrode "b" made of a metal material. The Y electrode 101 and the Z electrode 102 together form an electrode pair. The Y electrode 101 and the Z electrode 102 are covered with at least one dielectric layer 103 for limiting a discharge current and for providing insulation. A protection layer 104, having magnesium oxide (MgO) deposited thereon to facilitate a discharge condition, is formed on the dielectric layer 103.

In the rear substrate 110, barrier ribs 111 in the form of a stripe pattern (or well type), for forming a plurality of discharge spaces, i.e., discharge cells, are arranged in a parallel manner. Further, a plurality of address electrodes 112 (X electrodes) for use in achieving an address discharge which, in turn, results in the generation of ultraviolet light, is disposed parallel to the barrier ribs 111. Red (R), green (G) and blue (B) phosphors 113, for emitting visible light for image display upon address discharge, are coated on a top surface of the rear substrate 110. A white dielectric layer 114, which protects the address electrodes 112 and reflects the visible light emitted from the phosphors 113 to the front substrate 100, is formed generally between the address electrodes 112 and the phosphors 113.

The plasma display panel constructed above includes a plurality of discharge cells in the form of a matrix, and a driving module having a driving circuit for supplying a given driving signal to the discharge cells. The coupling relation between the plasma display panel and the driving module will be described with reference to FIG. 2.

FIG. 2 illustrates the coupling relation between the plasma display panel 22 and the driving module. As shown, the driving module can include a data driver integrated circuit (IC) 20, a scan driver IC 21, and a sustain board 23.

The plasma display panel 22 receives an image signal from the outside, a data signal, which has undergone predetermined signal processing by the data driver IC 20, a scan signal from the scan driver IC 21, and a sustain signal output from the sustain board 23. Discharge occurs in selected cells, which are selected from among the plurality of cells in the plasma display panel 22 that have received the data signal, the scan signal, the sustain signal, and the like. In cells where discharge has occurred, light is emitted at a predetermined brightness.

FIG. 3 illustrates a method for implementing a gray scale image in a conventional plasma display panel 22. As shown, in order to provide a gray scale image in the conventional plasma display panel, each image frame is divided into a plurality of sub-fields, where each sub-field has a different number of emission. Each sub-field is subdivided into a reset period RPD for initializing all of the discharge cells, an address period APD for selecting a number of the discharge cells, and a sustain period SPD for implementing the gray scale according to the number of discharges. For example, if it is desired to display an image with 256 gray scales, a frame period (16.67 ms) corresponding to 1/60 of a second is divided into eight sub-fields SF1 to SF8, as shown in FIG. 3. Again, each of the eight sub-fields SF1 to SF8 is subdivided into a reset period, an address period and a sustain period.

The time period associated with the reset period and the address period of each sub-field is the same for every sub-field. The address discharge which results in the selection of certain cells is generated by establishing a voltage difference between the X electrodes and transparent Y electrodes corresponding to those cells, where Y electrodes refer to the scan electrodes and the X electrodes refer to the address electrodes.

The time period and the number of sustain pulses that are associated with the sustain periods increase by a ratio of $2^n$ (where, n=0, 1, 2, 3, 4, 5, 6, 7) for each sub-field SF1 to SF8, as shown in FIG. 3. As such, since the sustain period varies from one sub-field to the next, the gray scale of an image is achieved by controlling which sustain periods are to be used for discharging each of the selected cells, i.e., the number of the sustain discharges that are realized in each of the discharge cells. A driving waveform for use in a method of driving the plasma display panel will now be described with reference to FIG. 4.

FIG. 4 illustrates a driving waveform that is used for driving a plasma display panel in accordance with the prior art. As shown, during a given sub-field, the waveforms associated with the X, Y and Z electrodes are divided into a reset period for initializing all cell, an address period for selecting cells that are to be discharged, a sustain period for maintaining discharging of selected cells, and an erase period for erasing wall charges within each of the discharge cells.

During a set-up period of the reset period, a ramp-up waveform (Ramp-up) is applied to all of the Y electrodes at the same time. As a result, weak dark discharge is generated in all of the discharge cells for the entire screen. It will be understood that the term "dark discharge" refers to a discharge within a given cell that results in little or no visible light emission. The set-up discharge causes wall charges of a positive polarity to be accumulated at the X electrodes and the Z electrodes, and wall charges of a negative polarity to accumulate at the Y electrodes, where the Z electrodes refer to the sustain electrodes.

During a set-down period, after the ramp-up waveform is supplied, a ramp-down waveform (Ramp-down), which falls from a positive polarity voltage lower than the peak voltage of the ramp-up waveform, to a given voltage lower than a ground GND level voltage. This causes a weak erase discharge to occur in all of the cells. Therefore, excessive wall charges formed on the Y electrodes are sufficiently erased. The set-down discharge also optimizes the wall charges for the address period, such than an address discharge can be generated stably within the appropriate cells.

During the address period, while a negative scan signal (Scan) is sequentially applied to the Y electrodes, a positive data signal is applied to the X electrodes in synchronism with the scan signal. As a result of the voltage difference between the scan signal and the data signal, as well as the wall voltage generated during the reset period, an address discharge is generated within those discharge cells to which a data signal is applied. Furthermore, wall charges, sufficient for generating a discharge when a sustain voltage Vs is applied, are formed within cells selected by the address discharge. A positive polarity voltage Vz is applied to the Z electrodes so that erroneous discharge does not occur with the Y electrode by reducing the voltage difference between the Z electrode and the Y electrode during the set-down period and the address period.

During the sustain period, a sustain signal (Sus) is alternately applied to the Y electrodes and the Z electrodes. In cells selected during the address period, a sustain discharge, i.e., a display discharge, is generated between the Y electrodes and the Z electrodes whenever the sustain signal is applied.

After the sustain period is completed, there is an erase period, during which a voltage associated with an erase ramp waveform (Ramp-ers), which has a small pulse width and a low voltage level, is applied to the Z electrodes, so that wall charges remaining within all of the cells are erased.

In a plasma display panel driven with the driving waveform of FIG. 4, when the data signal is applied to the X electrodes during the address period, the data signal is applied to all of the X electrodes X1 to Xn at the same time. The point in time that the data signal is applied during the address period in accordance with the prior art, will now be described with reference to FIG. 5.

FIG. 5 is a conceptual view that illustrates the point in time the data signal is applied in a conventional plasma display panel. As shown in FIG. 5, in the conventional plasma display panel, the data signal is applied to all the X electrodes X1 to Xn at the same time point t0. This introduces noise which affects the waveform applied to the Y electrodes as well as the waveform applied to the Z electrodes. An example where such noise is affecting the waveform applied to the Y electrodes and the waveform applied to the Z electrodes, when a corresponding data signal is applied to all of the X electrodes X1 to Xn at the same time, is described below described with reference to FIG. 6.

FIG. 6 illustrates the noise that may be associated with the waveforms applied to the Y electrodes and the Z electrodes due to the data signal applied to the X electrodes in a conventional plasma display panel. Referring to FIG. 6, in a conventional plasma display panel, if the data signal is applied to all the X electrodes at the same time during the address period, noise is generated which may affect the waveforms applied to the Y electrodes and the Z electrodes. This noise is generated due to coupling capacitance. Mores specifically, when the data signal abruptly rises, a rising amount of noise on the waveforms applied to the Y electrodes and the Z electrodes can be observed. When the data signal abruptly falls, a decreasing level of noise on the waveforms applied to the Y electrodes and the Z electrodes can be observed.

As described above, the noise may affect the waveforms applied to the Y electrodes and the Z electrodes due to the data signal being applied to the X electrodes at the same time, makes the address discharge unstable, thereby degrading driving efficiency of the plasma display panel. Furthermore, it can seriously damage the scan board and/or the sustain board in the driving module.

SUMMARY OF THE INVENTION

Accordingly, the present invention addresses the above problems associated with the prior art, and it is an object of the present invention to provide a plasma display panel and driving method thereof, which controls the point in time when data signals are applied to the X electrodes during an address period, thereby reducing the noise that would otherwise affect the waveforms applied to the Y electrodes and/or the Z electrodes, stabilizing address discharge, and preventing damage to the scan board and/or the sustain board.

In accordance with one aspect of the present invention, the various objects and advantages of the present invention are achieved by an apparatus for driving a plasma display, where the plasma display has a plurality of scan electrodes and a plurality of data electrodes that intersect the scan electrode. The apparatus includes a scan driver for applying a scan pulse to one of the plurality of scan electrodes and a data driver for applying a data signal to each of a plurality of data electrode groups, during a time period corresponding to the scan pulse. The application time point for at least one of the plurality of data electrode groups is different from the application time point corresponding to each of the other data electrode groups, and each of the plurality of data electrode groups includes one or more data electrodes.

In a method of driving a plasma display panel according to an embodiment of the present invention, data electrodes are divided into a plurality of electrode groups, where one or more electrode groups are driven by data signals at a point in time that is different from the remaining electrode groups.

In a method of driving a plasma display panel according to another embodiment of the present invention, during an address period, each of the data signals that is used to drive the data electrodes is applied to a corresponding data electrode at a different point in time.

In a method of driving a plasma display panel according to still another embodiment of the present invention, a circuit applies data signals to the data electrodes during the address period according at two or more different times.

BRIEF DESCRIPTION OF THE DRAWINGS

Further objects and advantages of the invention can be more fully understood from the following detailed description taken in conjunction with the accompanying drawings in which.

DETAILED DESCRIPTION OF THE PREFERRED EMBODIMENT

A method of driving a plasma display panel according to the present invention will now be described in detail in connection with preferred embodiments and with reference to the accompanying drawings.

Figure 7:
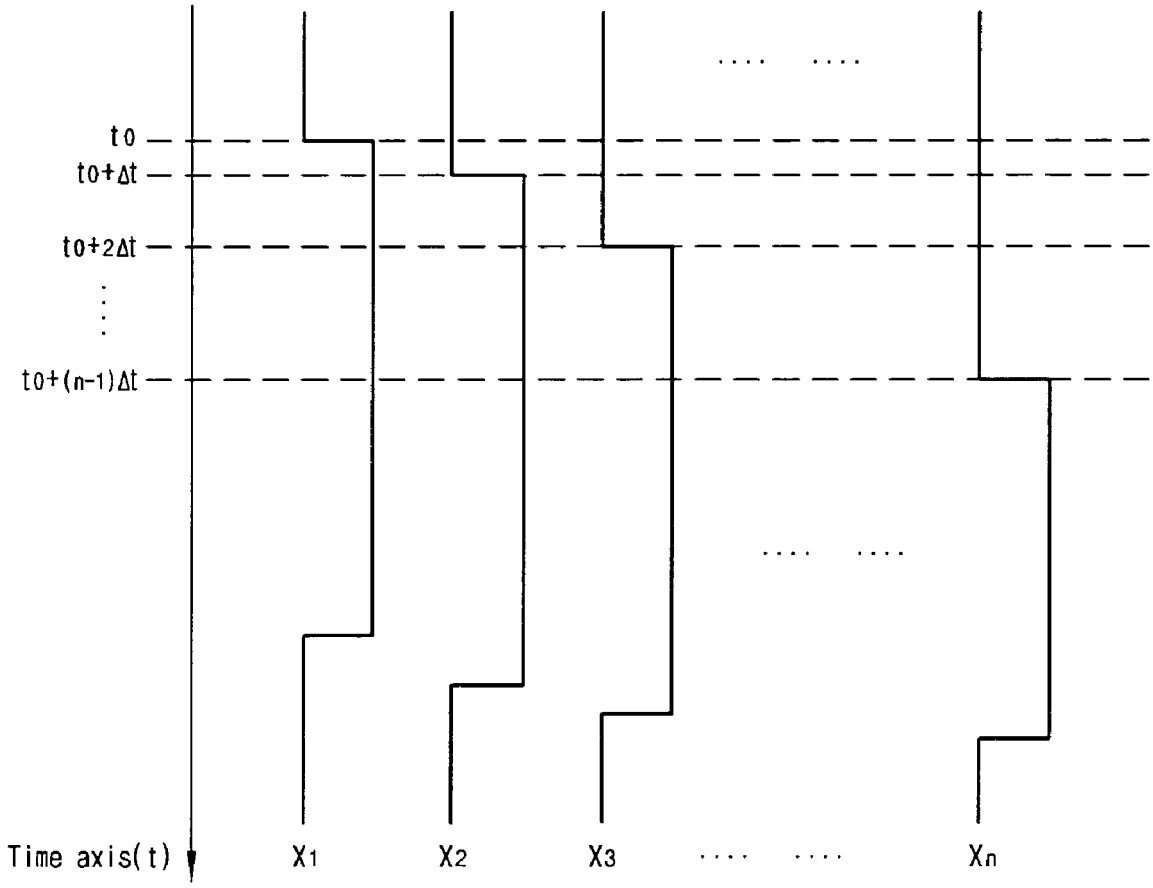
FIG. 7 is a conceptual view for explaining an application time point of the data signal in a method of driving a plasma display panel according to an embodiment of the present invention.

FIG. 7 is a conceptual view that illustrates the timing sequence associated with applying the data signal in a method of driving a plasma display panel according to an embodiment of the present invention. Referring to FIG. 7, data signals are applied to all X electrodes X1 to Xn at different time points t0 to tn during an address period. As shown, for example, the data signal is applied to the electrode X1 at the time t0, the data signal is applied to the electrode X2 at the time t0+Δt, and the data signal is applied to the Xn electrode at the time t0+(n−1)Δt. For instance, assuming data signals are applied to each of the X electrodes X1 to Xn at each of a number of application time points tm, where m varies from 0 to n−1, the time between each of the application time points is Δt, where Δt remains constant.

On the contrary, a time difference Δt between the application time points can vary. For example, assuming data signals are applied to each of the X electrodes X1 to Xn at each of a number of application time points tm, where m varies from 0 to n−1, the time between each of the application time points is Δt, where Δt can vary (i.e., have two or more values). That is, a data signal may be applied to electrode X1 at a time point of 10 ns, the data signal may be applied to electrode X2 at a time point of 20 ns, and the data signal may be applied to electrode X3 at a time point of 40 ns.

In this case, the time difference Δt between the application time points can be set from 10 ns to 1000 ns. The reason for this will now be described in conjunction with FIG. 8.

Figure 8:
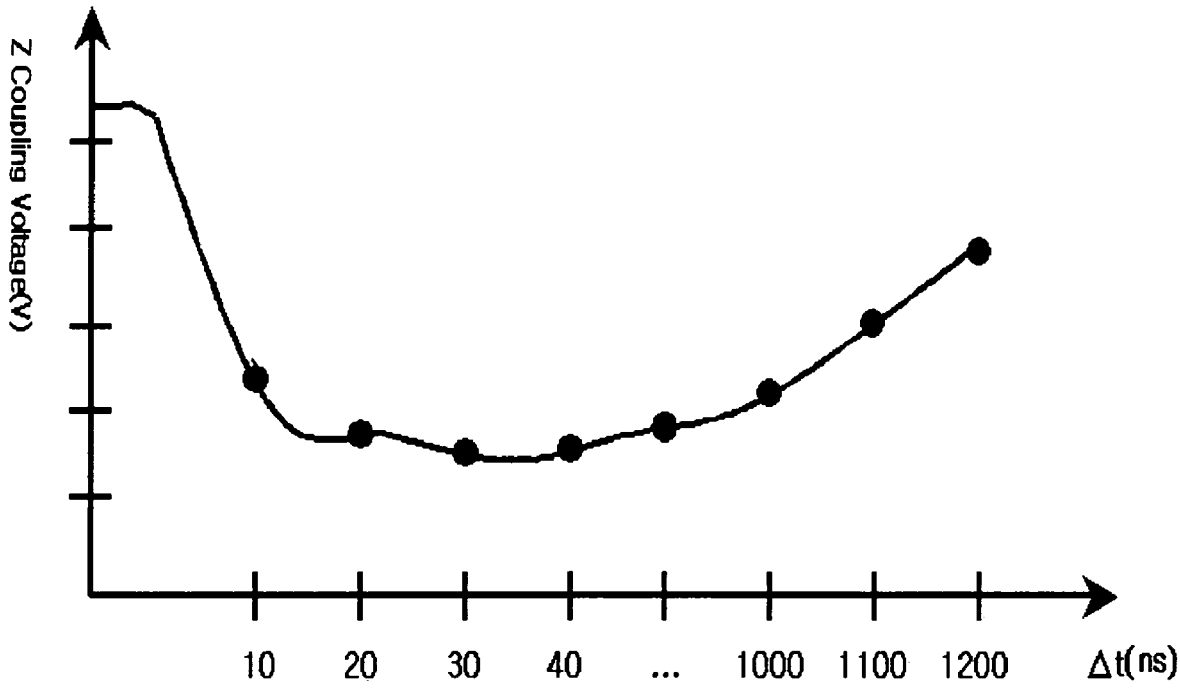
FIG. 8 is a view for explaining a coupling voltage depending upon variation in a difference between application times of data signals.

FIG. 8 illustrates coupling voltages and how coupling voltage is a function of the time difference between data signal application times. For example, as shown in FIG. 8, in the case where the difference between the data signal application time points is less than 10 ns, i.e., Δt is set to a value that is less than 10 ns, the coupling voltage is relatively high. Likewise, when the difference between the data signal application time points is greater than 1000 ns, i.e., Δt is set to be 1000 ns or more, the coupling voltage is relatively high. However, where the difference Δt between the data signal application time points is set to a range of 10 ns to 1000 ns, the coupling voltage is relatively low.

The time difference Δt may be set with respect to the pulse width of the scan pulses, depending on the plasma display panel. Thus, Δt may range from one-one hundredth of a scan pulse width to a time that equals 1 scan pulse width. For example, assuming that the pulse width of one scan pulse is 1 μs (i.e., 1000 ns), the time difference Δt between application time points may range from one-one hundredth of a scan pulse width, i.e., 10 ns, to a value equal to one scan pulse width, i.e., 1000 ns or less.

As such, if the difference in time Δt between the application time points of the data signals during the address period is set, for example, between 10 ns and 1000 ns, coupling through capacitance in the panel (i.e., coupling voltage) is reduced at the application time point of each of the data signals when applied to the X electrodes. This results in a reduction of noise for the waveforms applied to the Y electrodes and the Z electrodes.

Meanwhile, as shown in FIG. 7, the data signals are applied to all the X electrodes X1 to Xn at different time points t0 to tn. It is, however, to be noted that at least one of the data signals applied to the X electrodes X1 to Xn can be applied at the same time point to a group of two or more X electrodes, where the group of two or more X electrodes is less than n. This method will now be described with reference to FIG. 9.

Figure 9:
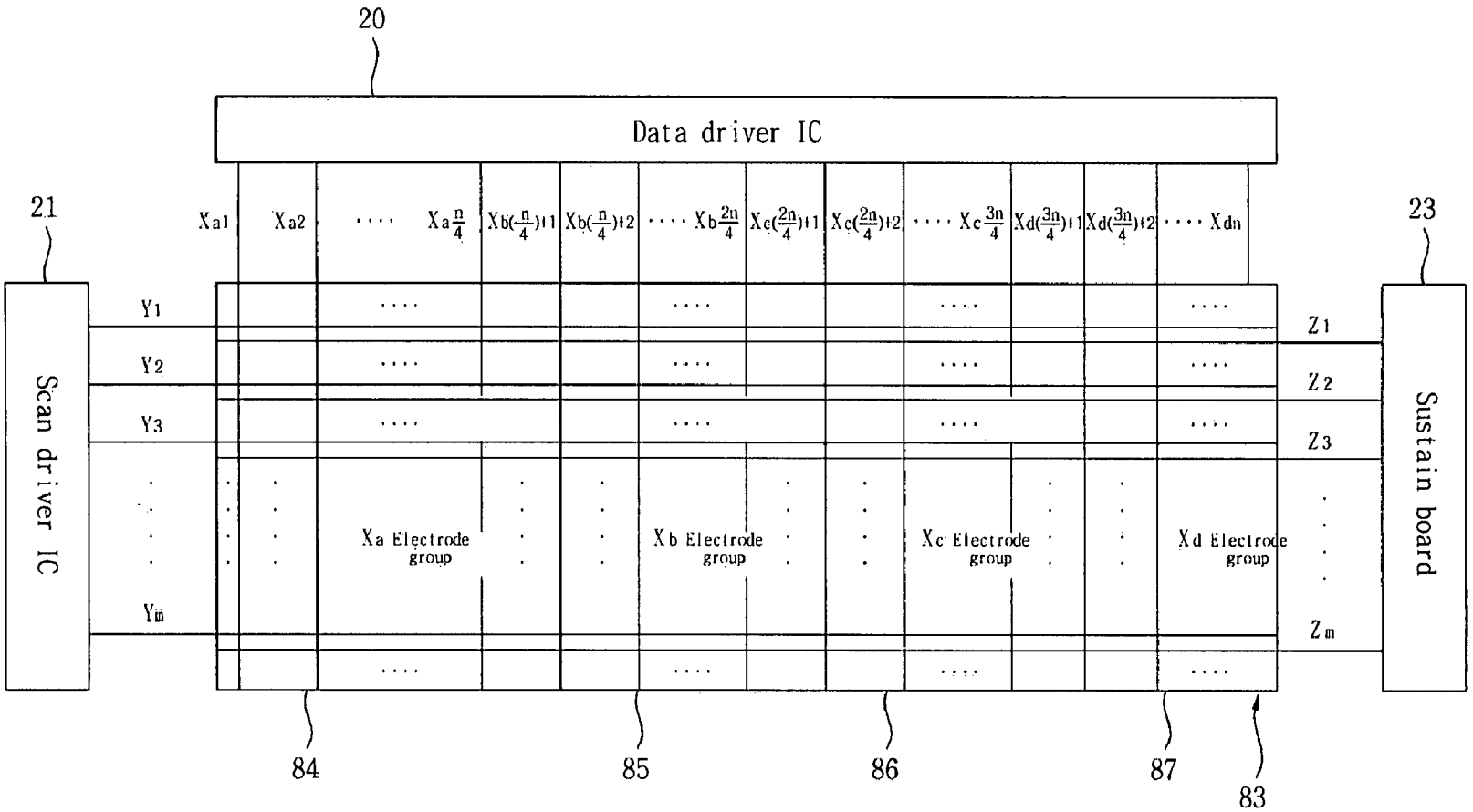
FIG. 9 is a view for explaining that X electrodes are divided into four X electrode groups so as to explain an application time of a data signal in a method of driving a plasma display panel according to another embodiment of the present invention.

FIG. 9 is a view showing the X electrodes divided into four X electrode groups in a method of driving the plasma display panel according to another embodiment of the present invention. More specifically, the electrodes X1 to Xn of the plasma display panel 83 are divided into, for example, an Xa electrode group 84 comprising X electrodes Xa1 to Xa(n)/4, an Xb electrode group 85 comprising X electrodes Xb((n/4)+1) to Xb (2n)/4, an Xc electrode group 86 comprising X electrodes Xc((2n/4)+1) to Xc(3n)/4, and an Xd electrode group 87 comprising X electrodes Xd((3n/4)+1) to Xd(n) 87. Each of the electrode groups Xa, Xb, Xc and Xd receive the data signal at a time point that is different from the other electrode groups. That is, all the electrodes Xa1 to Xa(n)/4 belonging to the Xa electrode group 84 receive the data signal at the same time point, whereas the electrodes belonging to the remaining electrode groups 85, 86 and 87 receive the data signal at a time point that is different from the time point associated with the electrodes Xa1 to Xa(n/4) belonging to the Xa electrode group 84.

Although it has been shown in FIG. 9 that the number of X electrodes included in each of the X electrode groups Xa, Xb, Xc and Xd is the same, the number of X electrodes included in each X electrode group can be different. Thus, for example, in one exemplary embodiment, a given electrode group may have but one electrode. However, in another exemplary embodiment, a given electrode group may have all but one electrode. Furthermore, the electrodes may be grouped sequentially within each electrode group. So, for example, as shown in FIG. 9, if there are four electrode groups Xa, Xb, Xc and Xd, and n number of electrodes, the first electrode group Xa might comprise the first n/4 electrodes in sequence, the second electrode group Xb might comprise the second n/4 electrodes in sequence, the third electrode group Xc might comprise the third n/4 electrodes in sequence and the fourth electrode group Xd might comprise the fourth n/4 electrodes in sequence. Alternatively, the electrodes might be randomly distributed amongst the electrode groups.

In addition, the number of X electrode groups can also vary (i.e., more or less than four electrode groups). For example, the number of X electrode groups according to an embodiment of the present invention can range from a minimum 2 electrode groups to a maximum number of n, where it will be understood that the maximum number of electrode groups n reflects the embodiment illustrated in FIG. 7. As such, the number of X electrode groups is determined based on the circuitry used for applying the data signal, and more specifically the amount of heat that is generated by the circuitry when driving the plasma display panel. An example of this method for determining the number of electrode groups will be described in conjunction with FIG. 10.

Some PDP devices employ a dual scan method, where the scan electrodes are divided into a first group (e.g., an upper group) and a second group (e.g., a lower group). The two groups of scan electrodes are then driven simultaneously (i.e., in parallel). This, of course, substantially reduces the amount of time needed to drive the scan electrodes. The concept of dual scanning is well known in the art. However, if the PDP device employs dual scan, each of the data electrodes is essentially divided in half, where one half (e.g., the upper half) of the data electrodes corresponds with the first or upper group of scan electrodes, and the other half (e.g., the lower half) of the data electrodes corresponds with the second or lower group of scan electrodes. The upper half and the lower half of the data electrodes would be driven independently using separate data drivers. In accordance with the various embodiments of the present invention, the data electrodes may, nevertheless, be divided into electrode groups, such as eight electrode groups Xa-Xh, as illustrated in FIG. 14, where the data signals applied to the data electrode groups associated with either the first or the second scan electrode group, may be offset in time as previously described to minimize the noise that would otherwise affect the scan and/or sustain signals.

Figure 10:
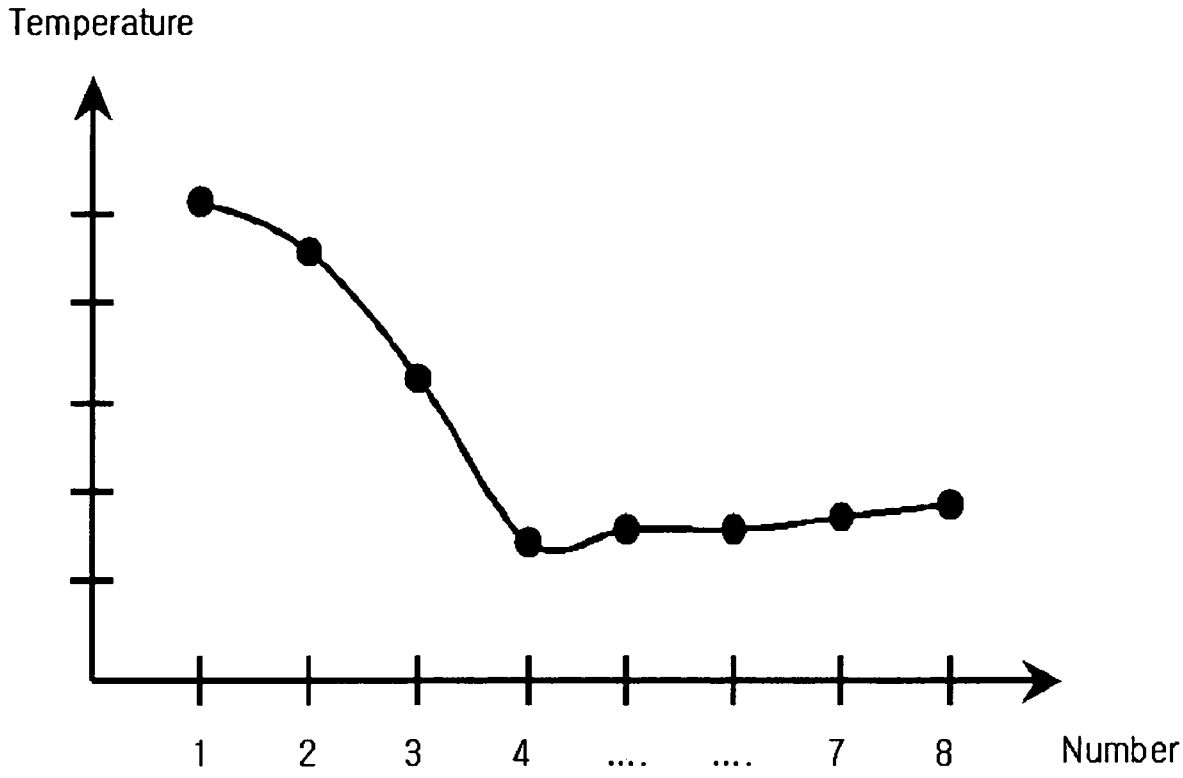
FIG. 10 is a view for explaining the relation between heat occurring when a plasma display panel is driven and the number of X electrodes groups.

FIG. 10 illustrates the relation between the heat that is generated in driving the plasma display panel and the number of X electrodes groups. As shown, the amount of heat that is generated when the plasma display panel is driven varies according to the number of the X electrode groups. For example, where the number of X electrode groups is less than 4, as shown in FIG. 10, the amount of heat that is generated when the plasma display panel is driven is relatively high. Furthermore, though not shown in FIG. 10, where the number of X electrode groups exceeds 8, the amount of heat that is generated when the plasma display panel is driven is also relatively high. Therefore, in order to minimize the amount of heat that is generated when a plasma display panel is driven, the number of X electrode groups is preferably set from 4 to 8.

Furthermore, the number of data electrodes included in each electrode group can be controlled. For example, the number of data electrodes included in one electrode group is preferably 100 to 1000, and more preferably 200 to 500, when considering the picture quality of VGA (Video Graphics Array), XGA (Extended Video Graphics Array) and HDTV (High Definition Television) systems.

Referring back to FIG. 9, this figure shows a structure that includes a data driver IC 2D, a scan driver IC 21 and a sustain board 23 connected to the X, Y and Z electrodes of the panel 83, respectively. Although the scan driver IC 21, the data driver IC 20 and the sustain board 23 are shown spaced apart from the panel 83, in reality, the data driver IC 20, the scan driver IC 21 and the sustain board 23 are all coupled to the panel 83.

The application time points associated with the data signals of a plasma display panel divided into the four X electrode groups Xa, Xb, Xc and Xd, as shown in FIG. 9, will now be described with reference to FIG. 11. As shown, the application time points for the data signals applied to the electrodes that belong to the electrode groups (i.e., the Xa electrode group, the Xb electrode group, the Xc electrode group and the Xd electrode group) are the same for all the electrodes in any one of the electrode groups. However, the application time points for the data signals for each of the different electrode groups Xa, Xb, Xc and Xd are different. Thus, for example, each of the X electrodes belonging to the Xa electrode group (Xa1 to Xa(n4)) all receive the data signal at the same time point t0, the X electrodes belonging to the Xb electrode group (Xb((n/4)+1) to Xb(2n)/4) all receive the data signal at time point t0(+Δt), the X electrodes belonging to the Xc electrode group Xc((2n/4)+1) to Xc(3n)/4) all receive the data signal at time point t0+2Δt, and the X electrodes belonging to the Xd electrode group Xd((3n/4)+1) to Xd(n)) all receive the data signal at time point t0+3Δt. Assuming now that Xd((3n/4)+1) from one application time point tm to the next application time point t(m+1), where m ranges from 0 to D−1, and where D equals the total number of X electrode groups, the time difference between consecutive application time points is Δt, where Δt remains constant. That is, in this embodiment, the time difference between consecutive application time points does not change (i.e., tm−t(m+1)=Δt=constant).

Alternatively, the time difference Δt between application time points can vary. Thus, assuming that consecutive application time points, each associated with a corresponding X electrode group, are represented by tm and t(m+1), where m ranges from 0 to D−1, and where D equals the number of X electrode groups, the time difference between consecutive application time points Δt would have two or more values. For example, the electrode group Xa illustrated in FIG. 9 may receive the data signal at a time point 10 ns, the electrode group Xb may receive the data signal at a time point 20 ns, and the electrode group Xc may receive the data signal at a time point 40 ns. Preferably, the time difference Δt between consecutive application time points range from 10 ns to 1000 ns, where 1000 ns equals the typical scan pulse width, and where 10 ns equals one-one hundredth of a typical scan pulse width.

If the data signals are applied in accordance with the various embodiments of the present invention, noise due to capacitive coupling, which affects the waveforms applied to the Y electrodes and the Z electrodes, will be minimized. This will be further explained with reference to FIG. 12.

Figure 1:
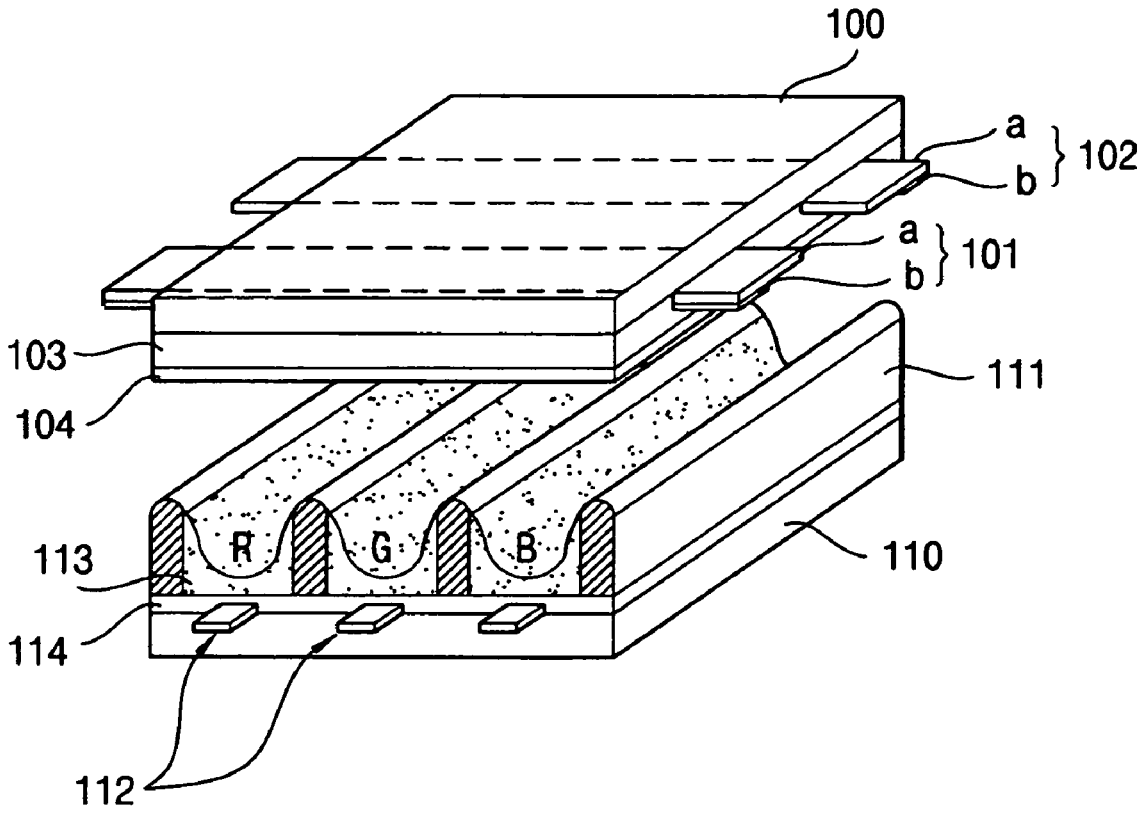
FIG. 1 illustrates the configuration of a conventional plasma display panel.
Figure 2:
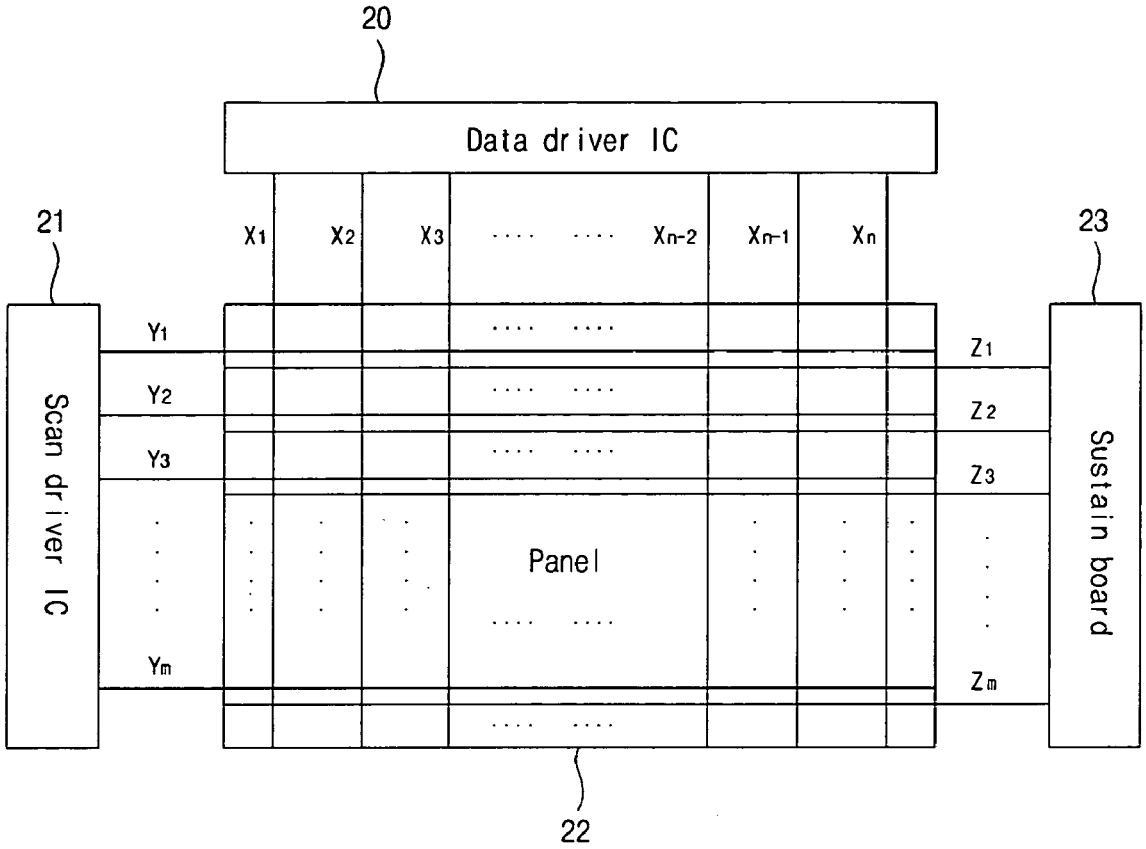
FIG. 2 illustrates the relation between a conventional plasma display panel and a driving module.
Figure 3:
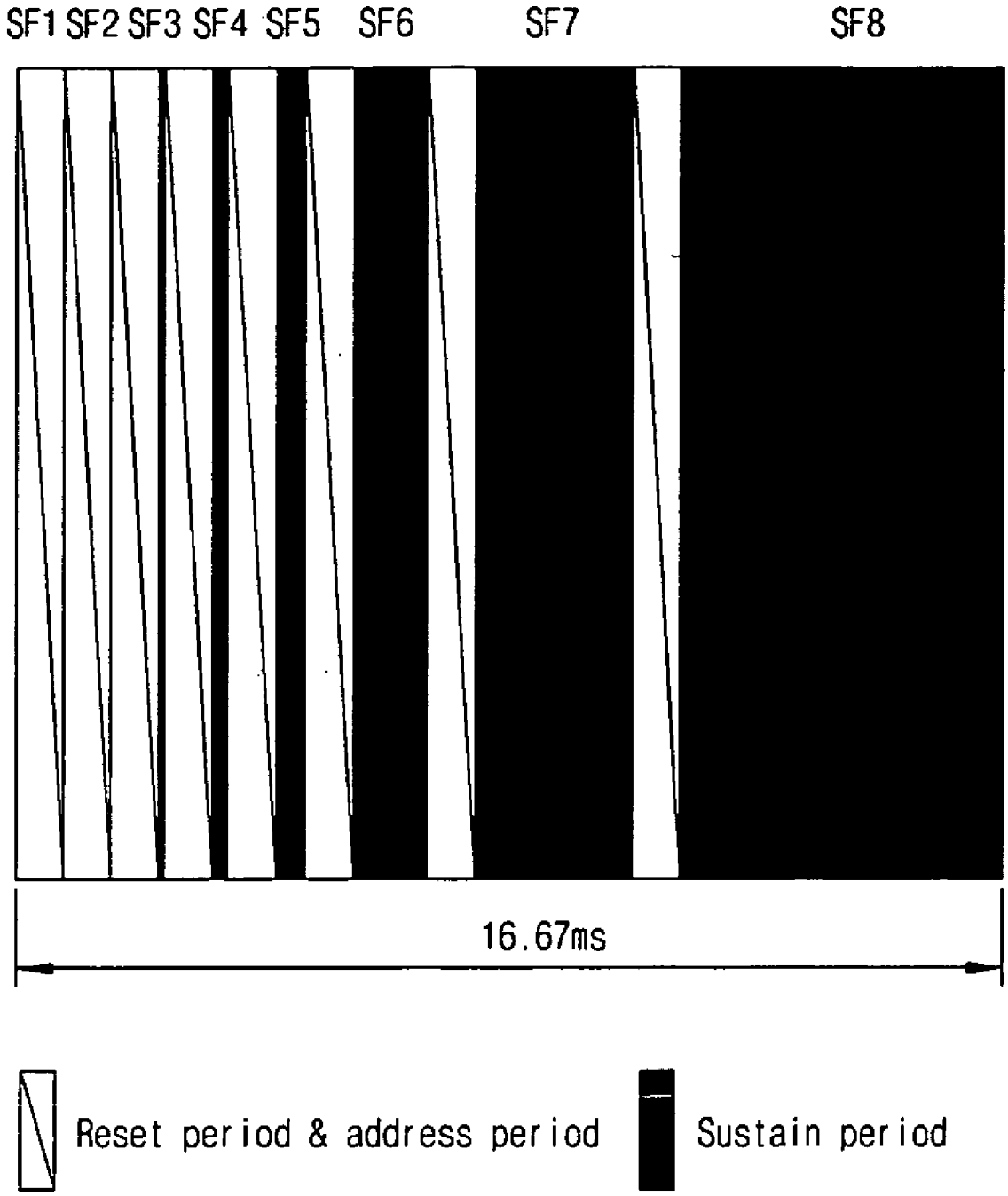
FIG. 3 illustrates a method for implementing a gray scale image in a plasma display panel in accordance with the prior art.
Figure 4:
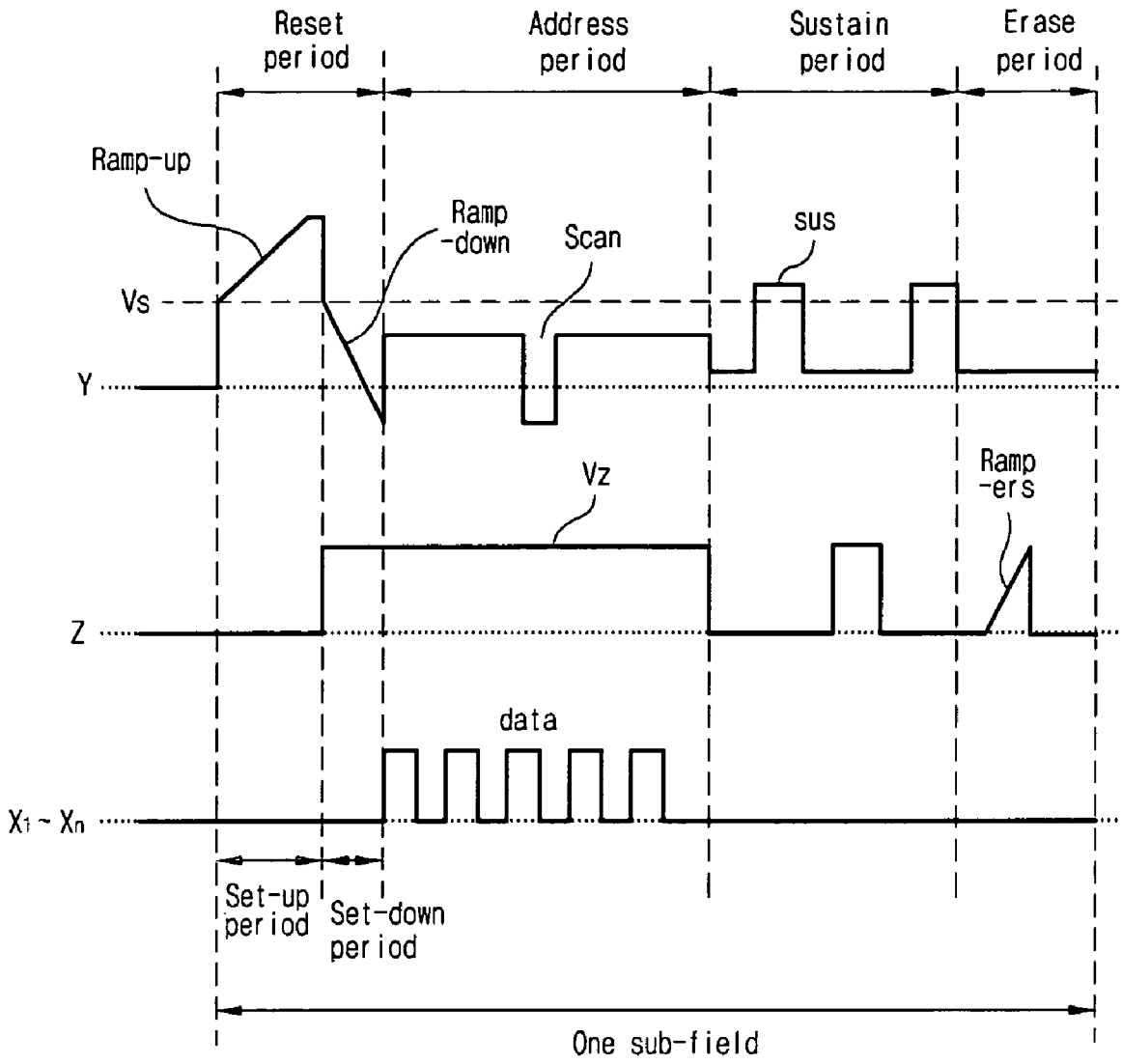
FIG. 4 illustrates a driving waveform that is used in a method of driving a plasma display panel in accordance with the prior art.
Figure 5:
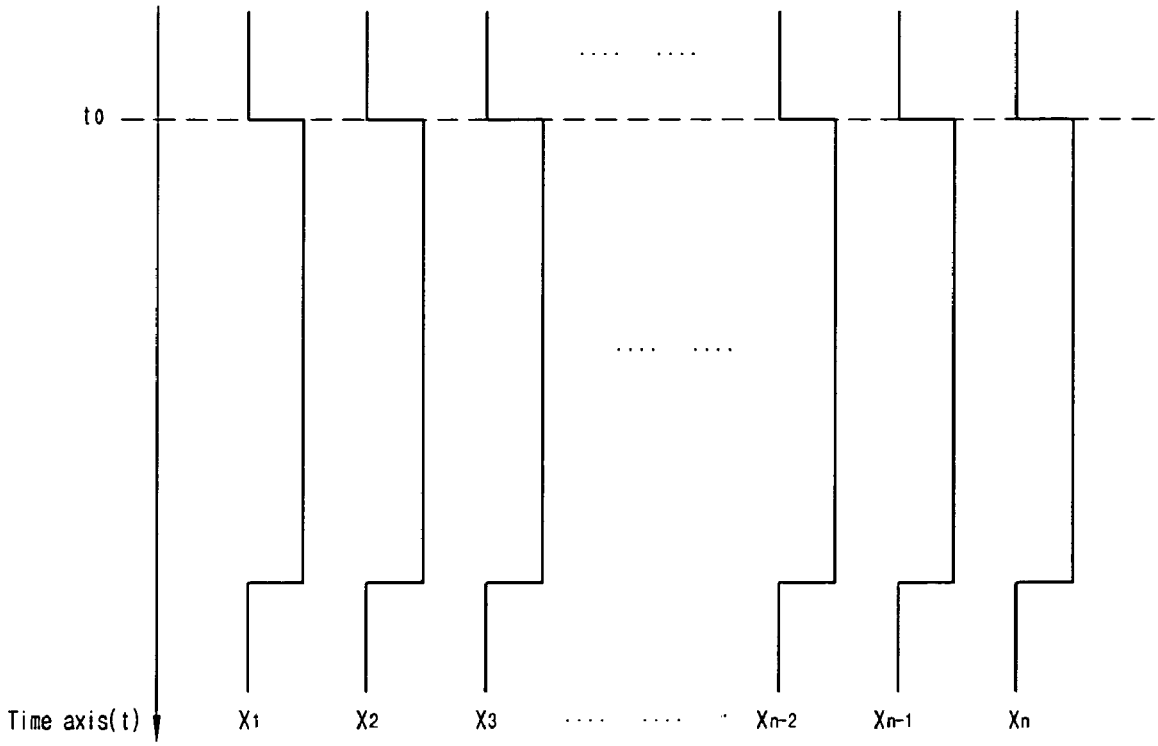
FIG. 5 is a conceptual view illustrating the timing sequence of a data signal in a conventional plasma display panel.
Figure 6:
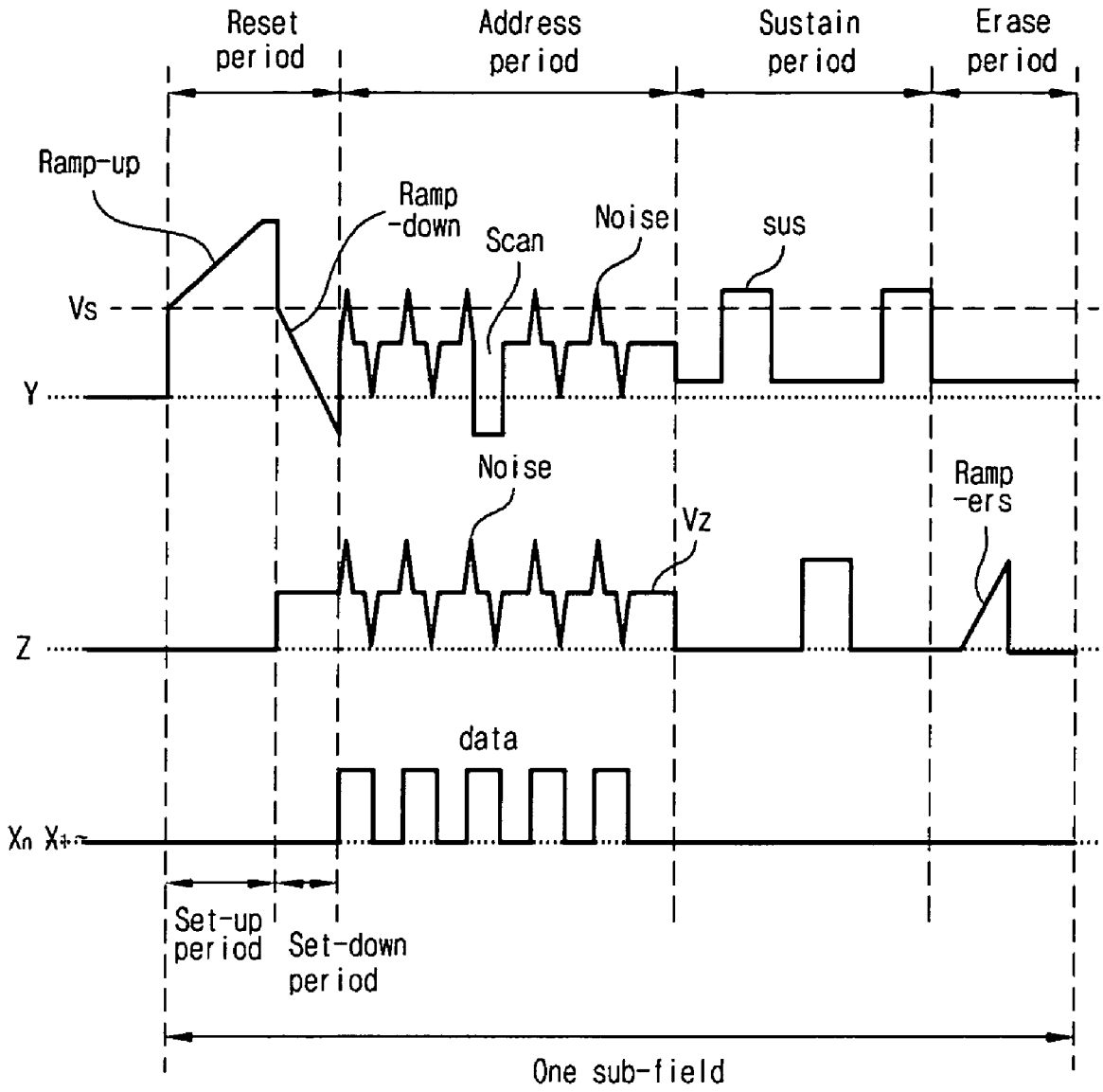
FIG. 6 illustrates the noise affecting the waveform applied to Y electrodes and Z electrodes due to the timing sequence of a data signal applied to X electrodes in a conventional plasma display panel.
Figure 11:
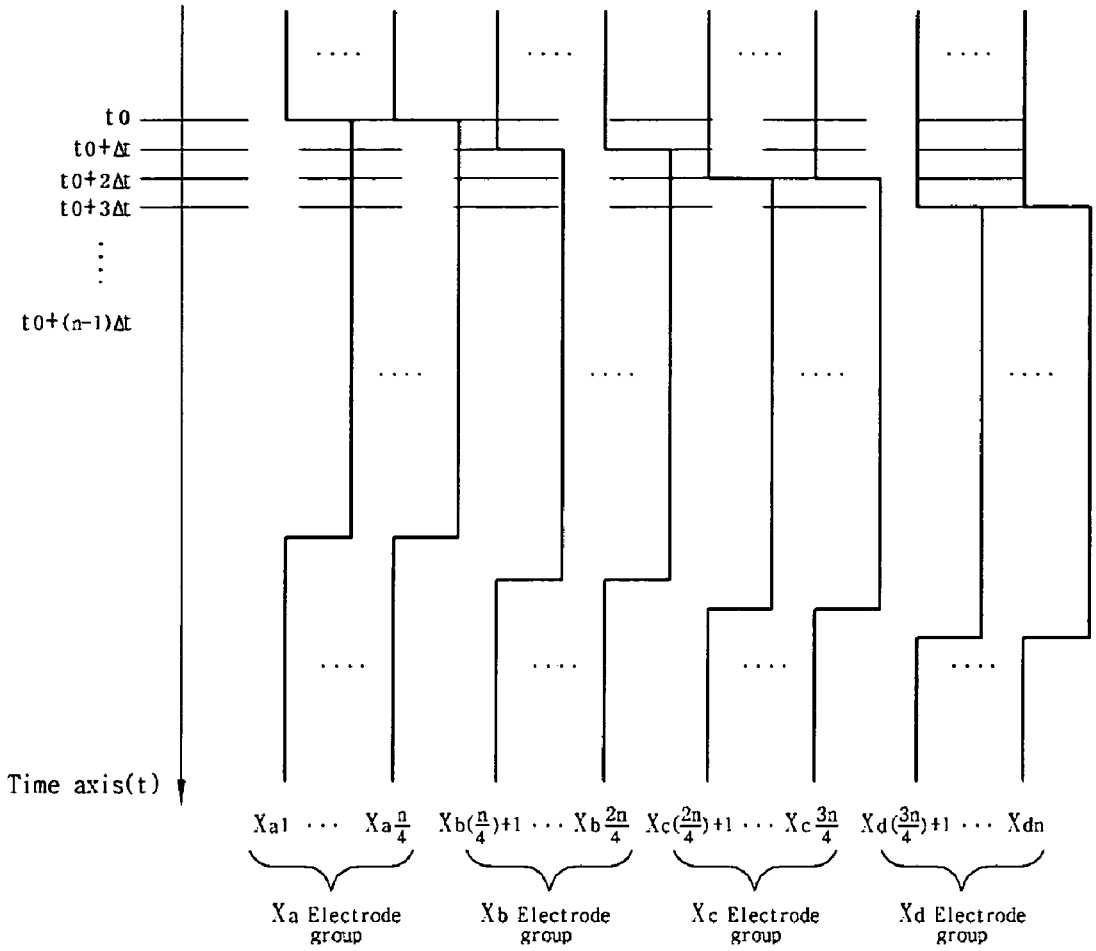
FIG. 11 shows the application time points of the data signals in case of FIG. 9.
Figure 12:
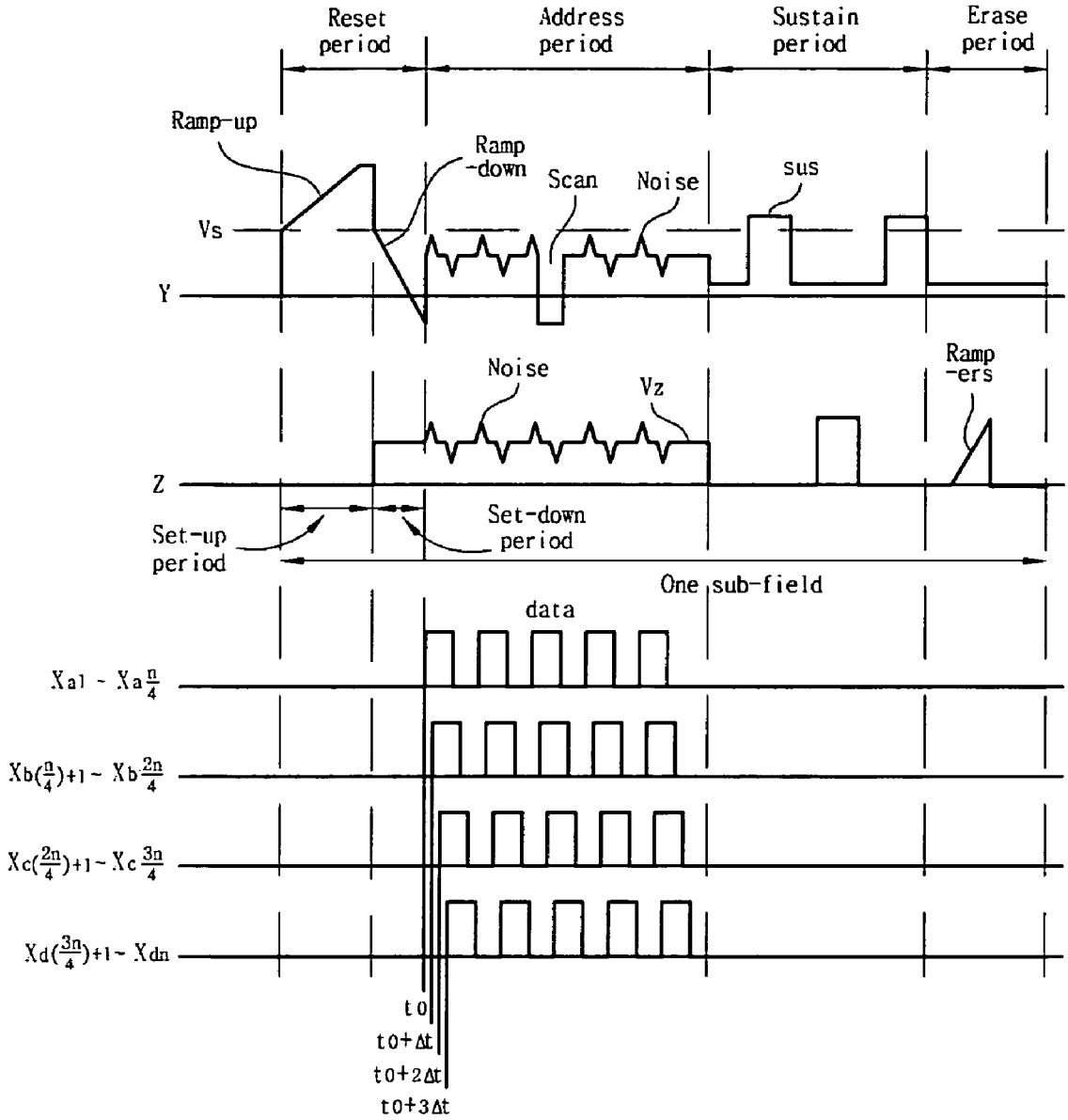
FIG. 12 is a view for explaining noise of a waveform applied to the Y electrode and the Z electrode, which is caused due to the data signals applied to the X electrode in case of FIG. 11.

FIG. 12 illustrates the noise that might affect the waveforms applied to the Y electrodes and the Z electrodes due to the data signals applied to the X electrodes as shown in FIG. 11. As shown, this noise affecting the waveforms applied to the Y electrodes and the Z electrodes is significantly reduced as compared to FIG. 6. In this case, in order to reduce the voltage coupling through capacitance in a panel at each application time point, the data signals are, for example, applied to four electrode groups (Xa, Xb, Xc and Xd) beginning at different time points (to, to+Δt, to+2Δt, to+3 Δt). Thus, the X electrodes X1 to Xn do not receive the data signal all at the same time point. Accordingly, the positively increasing noise level affecting the waveforms applied to the Y electrodes and the Z electrodes is reduced at the point in time where the data signal abruptly rises (i.e., the rising edge of the data signal), and where the negatively increasing noise level affecting the waveforms applied to the Y electrodes and the Z electrodes is reduced at the point in time where the data signal abruptly falls (i.e., the falling edge of the data signal). The resulting noise reduction stabilizes the address discharge occurring in the address period. This, in turn, prevents the degradation of efficiency in driving a plasma display panel.

The waveform shown in FIG. 12 is only illustrative, but the technical spirit of the present invention is not limited thereto. It is thus to be appreciated that the waveform can be modified in various manners by those skilled in the art without departing from the scope and spirit of the present invention.

For instance, as described above, each of the X electrodes X1 to Xn may receive the data signals at different time points, or all the X electrodes X1 to Xn may be divided into electrode groups such as four electrode groups, each having the same number of X electrodes, where the data signal is applied to each electrode group at a different application time point.

However, alternative methods are possible. For example, odd-numbered X electrodes may comprise one electrode group, while all of the even-numbered X electrodes comprise a second electrode group. In this instance, all electrodes within the same electrode group receive the data signal at the same time point, whereas the application time points of the data signals for each electrode group are set different.

In accordance with another alternative method, the X electrodes X1 to Xn can be divided into a plurality of electrode groups, where at least one of the electrode groups has a different number of X electrodes than the other electrode group or groups, and where the data signals are received at different application time points for each of the electrode groups. For example, electrode X1 may receive the data signal at a time point t0, the electrodes X2 to X10 may receive the data signal at a time point t0+Δt, and the electrodes X11 to Xn may receive the data signal at a time point t0+2Δt. As such, the method of driving the plasma display panel according to the present invention can be modified in a variety of manners.

Figure 13:
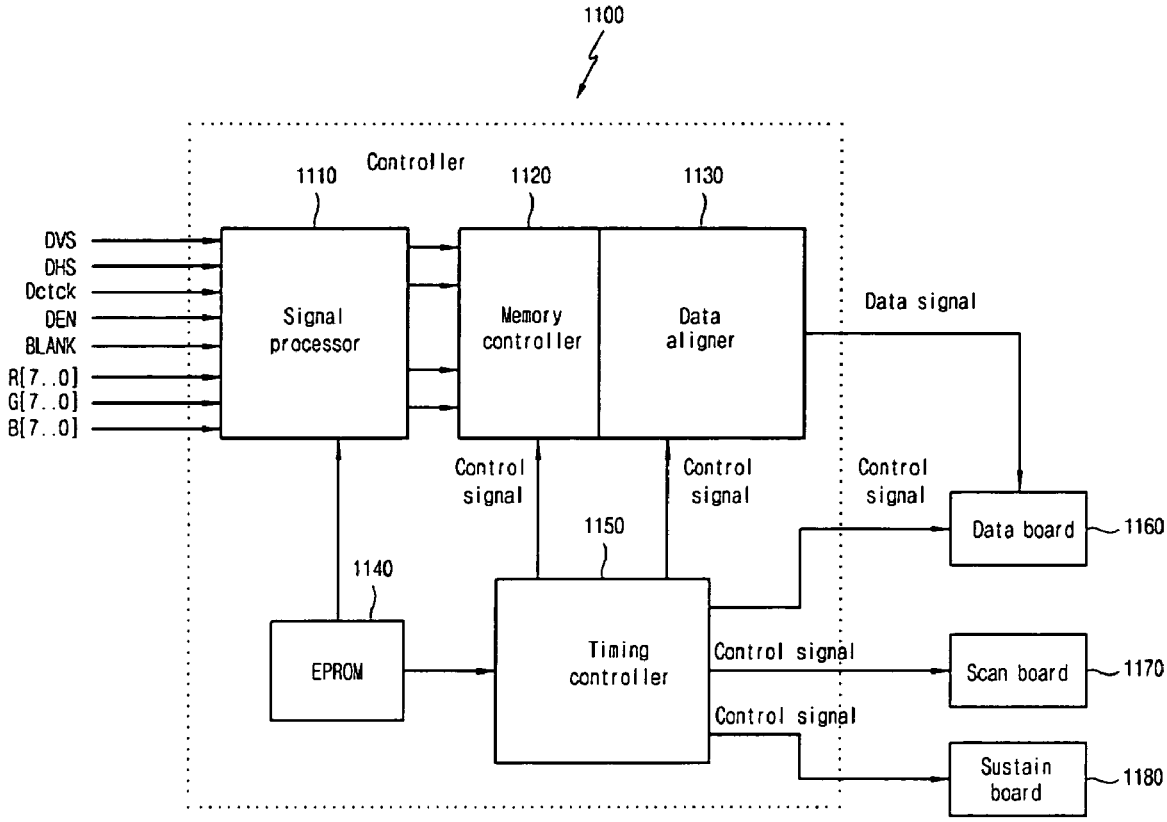
FIG. 13 is a block diagram schematically illustrating the configuration of a controller of the plasma display panel that is driven according to an embodiment of the present invention.

FIG. 13 is a block diagram schematically illustrating the configuration of a controller 1100 in a plasma display panel that is driven according to the exemplary embodiments of the present invention. As shown, the circuit module in FIG. 13 includes a control board, a data board 1160, a scan board 1170, and a sustain board 1180. The control board 1100 performs the core function which involves controlling the operation of the other boards. It also carries out a variety of other functions such as gamma processing, gain processing, error diffusion processing, APL (Average Picture Level) calculation, sub-field mapping (SFM) processing, operational timing processing of the data board, the scan board and the sustain board, and so on.

The controller 1100 is mounted on the control board, and includes a signal processor 1110, a memory controller 1120, a data aligner 1130, an EPROM (Erasable Programmable ROM) 1140, and a timing controller 1150, among other things.

The signal processor 1110 performs a gain process, a sub-field mapping process, an error diffusion process, an inverse gamma correction process, and an APL calculation process on DVS, DHS, DEN, and the R, G, B signals. The memory controller 1120 stores various signals received from the signal processor 1110, and processes those signals under the control of the timing controller 1150. The data aligner 1130 aligns various data signals received from the memory controller 1120, and transmits the aligned data signals to the data board 1160 according to a control signal from the timing controller 1150. The EPROM 1140 stores a scan table, a sub-field mapping table, a timing table, an APL table, and various other parameters. Accordingly, the signal processor 1110 and the timing controller 1150 perform their desired operations using the various tables stored in the EPROM 1140.

Meanwhile, according to the embodiments of the present invention, the timing table stored in the EPROM 1140 contains a data signal timing table for one or more data signals that are applied to a data driver IC (not shown) mounted on the data board 1160. The data signal timing table stored in the EPROM 1140 stores information on data signal application time points for the data electrodes included in two or more electrode groups. That is, the data signal timing table stores information that defines the data signal application time points, where each of the data signal application time points corresponds to an electrode group. Thus, data electrodes in the same electrode group receive the data signals at the same time point, as defined by the information stored in the data signal timing table, and where each of the data signal application time points associated with each of the electrode groups have different values for at least two electrode groups. The data signal timing table can also store information on data signal application time points, where the time points are different for every data electrode. In this case, the data signals are received by each of the data electrodes at different time points.

Furthermore, information concerning data signal application time points can be stored in the form of Δt, which is the difference in time between consecutive data signal application time points, whether or not each application time point corresponds to an electrode group or individual electrodes. As stated above, Δt can have a value ranging from approximately 10 ns to approximately 1000 ns.

Further, in FIG. 13, the EPROM 1140 has been described, for example, as a storage medium for storing various tables including the data signal timing table. It is to be understood that the storage medium is not limited to an EEPROM, but can include a ROM type storage medium or a non-volatile storage medium, such as EPROM and flash ROM.

The timing controller 1150 reads information from the data signal timing table stored in the EPROM 1140, generates a control signal for applying a data signal, and sends the generated control signal to the data aligner 1130. The data aligner 1130 generates a data signal for applying aligned data according to the control signal received from the timing controller 1150. The data aligner 1130 then sends generated data signals to the data board 1160. However, the data signals sent by the data aligner 1130 are not sent at the same time. Rather, two or more data signals or all the data signals are sent at different time points.

In response to the data signals received from the data aligner, the data driver IC (not shown) mounted on the data board 1160 transfers data signals to corresponding data electrodes based on the received data signals. Thus, the noise that might otherwise affect the waveforms applied to the scan board 1170 or the sustain board 1180 due to panel coupling is reduced, and scan board 1170 and/or sustain board 1180 failures can be prevented.

As described above, the present invention involves controlling the time at which driving signals are applied to the X electrodes during the address period. By controlling the time at which the driving signals are applied to the X electrodes, the noise affecting the waveforms applied to the Y electrodes and Z electrodes can be reduced, and the address discharge can thus be stabilized. Accordingly, the present invention is advantageous in that it provides a more stable process for driving a plasma display panel, prevents the deterioration of driving efficiency, and prevents electrical damage to the scan board and/or sustain board.

While the present invention has been described with reference to particular illustrative embodiments, it is not to be restricted by these embodiments. It is to be appreciated that those skilled in the art can change or modify the embodiments without departing from the scope and spirit of the present invention.

What is claimed is:

1. An apparatus for driving a plasma display having a plurality of scan electrodes and a plurality of data electrodes that intersect the scan electrode, said apparatus comprising:

a scan driver that applies a scan pulse to one of the plurality of scan electrodes; and a data driver that applies a data signal to each of a plurality of data electrode groups, during a time period corresponding to the scan pulse, wherein the application time point for at least one of the plurality of data electrode groups is different from the application time point corresponding to each of the other data electrode groups, and wherein each of the plurality of data electrode groups includes one or more data electrodes, where, during the time period corresponding to the scan pulse, the time difference between each application time point and a next application time point ranges from one-one hundredth of the time period corresponding to the scan pulse width to an amount of time that equals the time period corresponding to the scan pulse.

2. The apparatus as claimed in claim 1, wherein the application time point corresponding to each of the plurality of data electrode groups is different within the time period corresponding to the scan pulse.

3. The apparatus as claimed in claim 1, wherein the number of data electrode groups is smaller than the total number of the data electrodes.

4. The apparatus as claimed in claim 1, wherein the number of data electrode groups is 4 to 8.

5. The apparatus as claimed in claim 1, wherein each of the plurality of data electrode groups includes the same number of data electrodes.

6. The apparatus as claimed in claim 1, wherein the number of data electrodes associated with one of the data electrode groups is the number of data electrodes associated with one or more of other data electrode groups.

7. The apparatus as claimed in claim 1, wherein the number of data electrodes associated with each of the plurality of data electrode groups is in the range of 100 to 1000 data electrodes.

8. The apparatus as claimed in claim 1, wherein the one or more data electrodes are sequentially grouped within each of the plurality of data electrode groups.

9. The apparatus as claimed in claim 1, wherein the one or more data electrodes are randomly grouped within each of the plurality of data electrode groups.

10. The apparatus as claimed in claim 1, wherein all data electrodes included in the same data electrode group receive the data signal from the data driver at the same application time point.

11. The apparatus as claimed in claim 1, wherein the data driver applies the data signal to each of the plurality of data electrode groups as a function of the scan pulse.

12. The apparatus as claimed in claim 1, where, during the time period corresponding to the scan pulse, the time difference between application time points is the same.

13. The apparatus as claimed in claim 1, where, during the time period corresponding to the scan pulse, the time difference between each application time point and a next application time point is different.

14. The apparatus as claimed in claim 1, where, during the time period corresponding to each scan pulse in a given sub-field, the time difference between each application time point and a next application time point is the same.

15. The apparatus as claimed in claim 1, where, during the time period corresponding to each scan pulse in a given sub-field, the time difference between each application time point and a next application time point is different.

16. The apparatus as claimed in claim 1, where, during the time period corresponding to the scan pulse, the time difference between each application time point and a next application time point ranges from 10 ns to 1000 ns.

17. The apparatus as claimed in claim 1, further comprising a storage medium in which a timing table is stored, wherein the timing table includes information that defines application time points.

18. An apparatus for driving a plasma display panel having a scan electrode and a sustain electrode, and a plurality of data electrodes crossing the scan electrode and the sustain electrode, said apparatus comprising:

a scan driver configured to apply a scan signal to the scan electrode; and a data driver configured to apply a data signal to at least two of the plurality of data electrodes at different application time points corresponding to the scan signal, wherein the time difference between each application time point and a next application time point associated with each of one or more scan signals during a given sub-field ranges from one one-hundredth of a predetermined scan pulse width to an amount of time that equals the predetermined scan pulse width.

19. The apparatus as claimed in claim 18, wherein the data driver applies the data signal at the different application time points as a function of the scan signal.

20. The apparatus as claimed in claim 18, wherein the time difference between each application time point and a next application time point associated with each of one or more scan signals during a given sub-field is the same.

21. The apparatus as claimed in claim 18, wherein the time difference between each application time point and a next application time point associated with each of one or more scan signals during a given sub-field is different.

22. The apparatus as claimed in claim 18, wherein the time difference between each application time point and a next application time point associated with each of one or more scan signals during a given sub-field ranges from 10 ns to 1000 ns.

23. The apparatus as claimed in claim 18 further comprising a storage medium in which a timing table is stored, wherein the timing table includes information that defines the application time points.

24. An apparatus for driving a plasma display panel having a scan electrode, a sustain electrode, and first and second address electrodes crossing the scan electrode and the sustain electrode, said apparatus comprising:

a scan driver for applying a sustain signal and a scan signal to the scan electrode;

a sustain driver for applying a sustain signal to the sustain electrode alternately with the sustain signal applied to the scan electrode; and a data driver for applying a first data signal at a first application time point to the first address electrode and for applying a second data signal at a second application time point to the second address electrode, wherein the first application time point is different from the second application time point, and wherein the first and the second application time points occur during a time period corresponding to the scan signal, wherein the time difference between the first application time and the second application time ranges from one one-hundredth of a predetermined scan pulse width to an amount of time that equals the predetermined scan pulse width.

25. An apparatus for driving a plasma display having a plurality of scan electrodes and a plurality of data electrodes that intersect the scan electrode, said apparatus comprising:

a scan driver configured to apply a first scan pulse to first scan electrode and, subsequently, apply a second scan pulse to a second scan electrode;

a data driver configured to apply a data signal to each of a first plurality of data electrode groups, during a time period corresponding to the first scan pulse, and subsequently, apply a data signal to each of a second plurality of data electrode groups, during a time period corresponding to the second scan pulse, wherein the application time period associated with the data signal applied to each of the first plurality of data electrode groups is different, and wherein the application time period associated with the data signal applied to each of the second plurality of data electrode groups is different, wherein the time difference between each application time point and a next application time point associated with the data signal applied to each of the first plurality of data electrode groups ranges from one one-hundredth of a pulse width of the first scan pulse to an amount of time that equals the pulse width of the first scan pulse, and the time difference between each application time point and a next application time point associated with the data signal applied to each of the second plurality of data electrode groups ranges from one one-hundredth of a pulse width of the second scan pulse to an amount of time that equals the pulse width of the second scan pulse.

26. The apparatus claimed in claim 25, wherein each of the first plurality of data electrode groups comprises a group of one or more data electrodes, and where each of the second plurality of data electrode groups comprises a group of one or more data electrodes.

27. The apparatus claimed in claim 26, wherein the first plurality of data electrode groups is different than the second plurality of data electrode groups.

28. A method for driving a plasma display apparatus having a scan electrode and first and second data electrodes crossing the scan electrode, the method comprising the steps of:

applying a scan pulse to the scan electrode; and applying a first data signal to the first data electrode at a first application time point, and a second data signal to the second data electrode at a second application time point, wherein the first application time point and the second application time point occur during a time period corresponding to the scan pulse, and wherein the first application time point and the second application time point are different, wherein the time difference between the first application time and the second application time ranges from one one-hundredth of a predetermined scan pulse width to an amount of time that equals the predetermined scan pulse width.

29. The method of claim 28, wherein the first data electrode is associated with a first one of a plurality of electrode groups, and the second data electrode is associated with a second one of a plurality of electrode groups, and wherein each of the plurality of data electrode groups comprises at least one data electrode.

30. The method of claim 29, wherein said step of applying a first data signal and applying a second data signal further comprises the step of:

applying a data signal to the at least one data electrode in each of the plurality of data electrode groups, wherein the application time point associated with each of the plurality of data electrode groups is different.

* * * * *